United States Patent [19]

Taniguchi et al.

[11] Patent Number: 4,970,856

[45] Date of Patent: Nov. 20, 1990

[54] BOBBIN SUPPLY SYSTEM FOR SPINNING FRAMES

[75] Inventors: Kaoru Taniguchi, Ishikawa; Motomi Ohta, Kanazawa, both of Japan

[73] Assignee: Kabushiki Kaisha Murao & Company, Kanazawa, Japan

[21] Appl. No.: 433,909

[22] Filed: Nov. 9, 1989

[30] Foreign Application Priority Data

Nov. 10, 1988 [JP] Japan ..... 63-284966

[51] Int. Cl.[5] ..... D01H 9/18; D01H 9/00; B65H 67/06

[52] U.S. Cl. ..... 57/281; 57/264; 57/276; 242/35.5 A

[58] Field of Search ..... 57/264–266, 57/274, 276, 281; 242/35.5 R, 35.5 A

[56] References Cited

U.S. PATENT DOCUMENTS

| | | | |
|---|---|---|---|
| 3,828,682 | 8/1974 | Klein | 57/281 X |
| 4,041,686 | 8/1977 | Inaba et al. | 57/281 |
| 4,683,713 | 8/1987 | Matsui et al. | 57/281 |
| 4,843,808 | 7/1989 | Ruge et al. | 57/264 |

*Primary Examiner*—John Petrakes

*Attorney, Agent, or Firm*—Oblon, Spivak, McClelland, Maier & Neustadt

[57] ABSTRACT

A bobbin transport system for spinning frames for supplying bobbins from bobbin reservoirs to spinning frames in a spinning mill. The spinning frames are divided into dedicated machine groups and a common machine group or groups. Bobbins are supplied to the dedicated machine groups by way of a main transport path and/or a sub transport path, and a communicating transport path for transferring bobbins from the sub transport path to the main transport path is provided for each of the spinning frames of the common machine group or groups. The bobbin transport system for spinning frames makes it possible to change the allotment of numbers of spinning frames for different types of yarns to be set for the common machine group or groups and to distribute different types of bobbins accurately to predetermined spinning frames thereby to enable production of several articles by small quantities without deteriorating the availability factor of the entire spinning frames.

8 Claims, 3 Drawing Sheets

BOBBIN SUPPLY SYSTEM FOR SPINNING FRAMES

FIELD OF THE INVENTION

This invention relates to a bobbin supply system for spinning frames for supplying a predetermined bobbin precisely to a predetermined spinning frame in accordance with a type of a yarn to be set on the spinning frame when a bobbin frame which a yarn has been unwound by a winder is to be returned to the spinning frame side.

BACKGROUND OF THE INVENTION

In a spinning mill, bobbins of cops unwound by a winder are normally returned to the spinning frame side in order to use them again. To this end, various bobbin supply systems have been proposed and put into practical use. Further, it is a very popular means to differentiate bobbins to be supplied to spinning frames from each other in accordance with types of yarns to be set on the spinning frames, for example, to differentiate such bobbins in color, to facilitate discrimination of types of yarns of cops for a next step.

In this manner, it is necessary for a bobbin supply system to supply a predetermined bobbin precisely to a predetermined spinning frame, and a simplest one of conventional bobbin supply systems for realizing such function is constituted such that, for example, a pair of bobbin supply devices B1 and B2 and a plurality of spinning frames S1, S2, . . . , Sm are communicated with each other by way of a single transport passage C (FIG. 5). Here, each of the bobbin supply devices B1 and B2 is constituted such that it forwards a bobbin of a predetermined type into the transport passage C in response to a bobbin requesting signal from a predetermined spinning frame S1 ($i=1, 2, \ldots, m$). Such bobbin requesting signal includes information representative of the spinning frame Si and information which specifies a type of a bobbin requested. It is to be noted that a bobbin change-over mechanism not shown which operates in response to a bobbin requesting signal is incorporated at each of branch points at which the transport passage C branches to the individual spinning frame Si. Thus, a bobbin transported from the upstream side of the transport passage C can be sent into a predetermined spinning frame Si by means of the corresponding change-over mechanism.

Further, m spinning frames S1, S2, . . . , Sm may be divided into two groups individually including k spinning frames and m-k simming frames, and a transport passage C and a pair of bobbin supply devices B1 and B2 may be provided similarly as in the system shown in FIG. 5 for each of the groups (FIG. 6). Such arrangement is advantageous in that the availability factor of the entire spinning frames can be improved because a bobbin supplying operation can be performed simultaneously to two spinning frames Si and Sj ($1 \leqq i \leqq k$, $k+1 \leqq j \leqq m$) which belong to the different groups from each other.

The prior art, however, has a problem that it cannot always be adapted precisely for a demand for lot production of many articles by small quantities which is conducted commonly in recent spinning mills. In particular, since normally the doffing period is different depending upon a type of yarn to be set on a spinning frame, in case various types of yarns are handled in the prior art arrangement shown in FIG. 5, there is the possibility that such an opportunity that a spinning frame having a comparatively short doffing period is rendered inoperative for a bobbin supplying operation for another spinning frame having a comparatively long doffing period may be increased, which will significantly deteriorate the overall availability factor.

On the other hand, while the overall availability factor can be improved as compared with the prior art arrangement shown in FIG. 5 if yarns of the same type are worked on spinning frames which belong to the same group, there is a problem that, since the number of spinning frames involved in each group is fixed, the arrangement cannot cope effectively with a variation in number of production lots of each yarn type.

OBJECT OF THE INVENTION

The present invention has been made in view of such circumstances as described above, and it is an object of the present invention to provide a bobbin supply system for spinning frames wherein the numbers of spinning frames on which yarns of different types are to be set can be changed at any time in accordance with a variation in number of production lots of yarns of different types and predetermined bobbins conforming to the yarn types to be set on the individual spinning frames can be supplied appropriately with certainty so that a plurality of types of yarns can be produced simultaneously by appropriate lot numbers without deteriorating the availability factor of the spinning frames.

SUMMARY OF THE INVENTION

In order to attain the object, according to the present invention, a bobbin supply system is constituted such that said spinning frames are divided into a plurality of dedicated machine groups each for working yarns of a fixed type and a common machine group disposed between each adjacent ones of said dedicated machine groups for working yarns of a selected one or ones of different types, and that said system comprises a main transport path capable of supplying bobbins to all of said dedicated machine groups and the common machine group or groups from the upstream side toward the downstream side, a sub transfer path joined to said main transport path at a boundary position between each of the common machine group or groups and an adjacent one of said dedicated machine groups on the downstream side of the common machine group for supplying bobbins to the spinning frames on the downstream side of the position, and a communicating transport path provided for each of the spinning frames of the common machine group or machine groups adjacent the boundary position or positions for establishing communication between said sub transport path and said main transport path.

With the bobbin supply system, bobbins are supplied by way of the main transport path at least to the spinning frames which belong to the most upstream side one of the dedicated machine groups while bobbins are supplied to the spinning frames which belong to any other dedicated machine groups by way of the sub transport path or main transport path corresponding to the dedicated machine group. On the other hand, bobbins can be supplied to the spinning frames which belong to any one of the common machine group or groups by way of the same route to that for an adjacent one of the dedicated machine groups on the upstream side of the common machine group. In this manner, the spinning frames which belong to each of the dedicated machine groups and the spinning frames which belong to an adjacent one of the common machine group or groups on the downstream side of the dedicated machine group form a group, and yarns of a same type are set for each group in operation.

When the numbers of the spinning frames which belong to the individual groups are to be changed, the communicating transport paths are used. In particular, when a certain one or ones of the spinning frames which belong to a common machine group are separated from an adjacent one of the dedicated machine groups on the upstream side and then combined with the spinning frames which belong to another adjacent one of the dedicated machine groups on the downstream side so as to form a new group, the communicating transport path corresponding to the most upstream side one of the certain spinning frame or frames is used to change to the position at which the communicating path is communicated with the main transport path. Consequently, the number of spinning frames which belong to each group can be changed by changing separation of the spinning frames of a common machine group.

DETAILED DESCRIPTION OF THE INVENTION

In the following, different embodiments of the present invention will be described with reference to the drawings.

Figure 1:
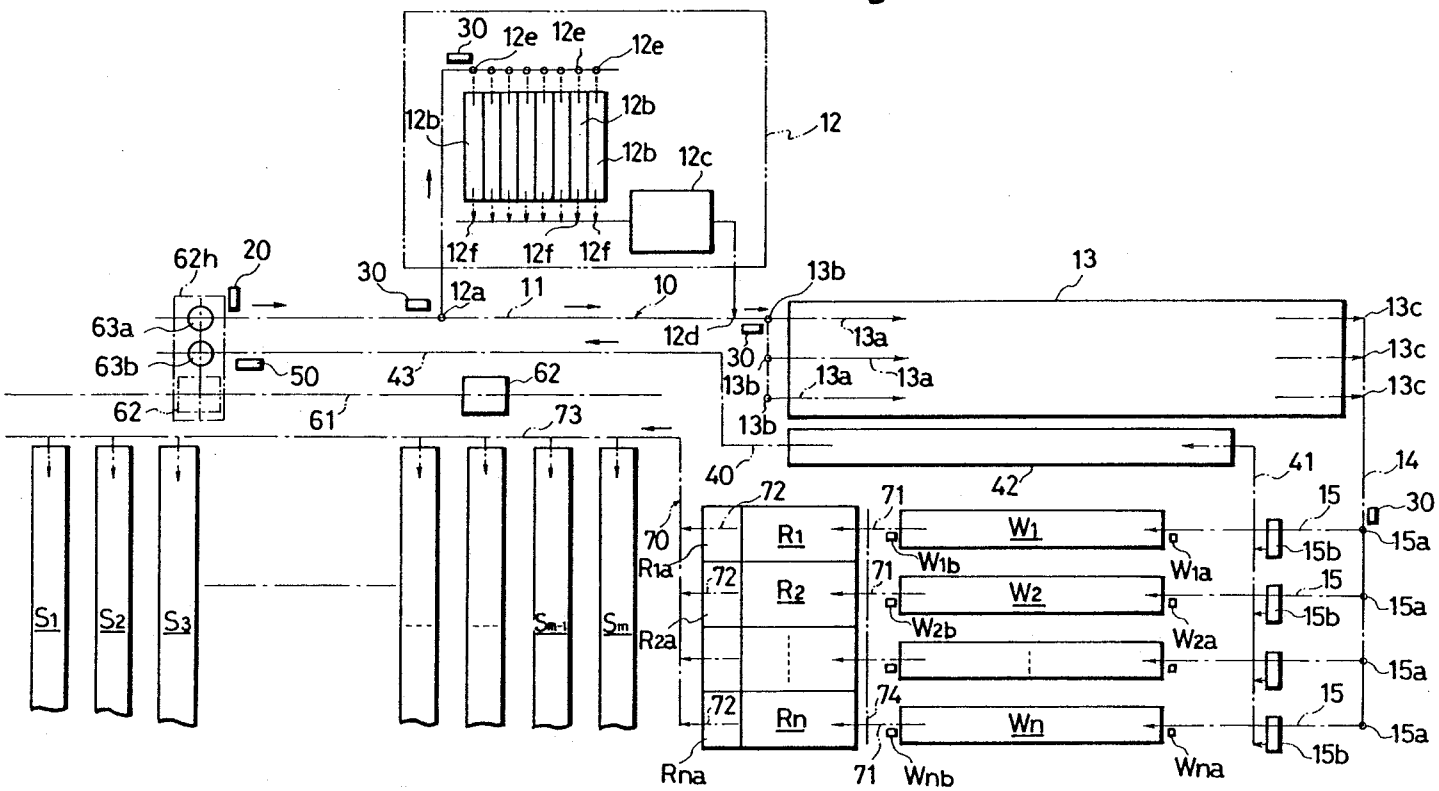
FIG. 1 is a diagrammatic representation of an entire bobbin supply system showing an embodiment of the present invention.

Referring to FIG. 1, a bobbin supply system for spinning frames includes, in combination, bobbin reservoirs Rj (j=1, 2, . . . , n) interposed between spinning frames Si (i=1, 2, . . . , m) arranged in a row and winders Wj (j=1, 2, . . . , n) and corresponding to the winders Wj, and a bobbin transport conveyor 70. It is to be noted that a cop transport system from the spinning frames Si to the winders Wj is also shown in FIG. 1.

The cop transport system is constituted such that it accommodates cops wound up on the spinning frames Si into predetermined cop magazines and transports them to the winders Wj by way of a cop transport conveyor system 10 which includes a forward conveyor 11, a working device line 12 which forms a bypass to the forward conveyor 11, a stock line 13, a communicating conveyor 14 which forms an exit passage from the stock line 13, and branch conveyors 15 which branch from the communicating conveyor 14 to the individual winders Wj.

A cop boxing device 62 is disposed on the out end side of the spinning frames Si and adapted to move back and forth by itself on a guide rail 61. The cop boxing device 62 is constituted such that it can stop on the out end side of a predetermined spinning frame Si and accommodates cops doffed from the spinning frame Si in an orderly fashion into a cop magazine, and then transport the cop magazine to a home position **62*h* provided on the guide rail 61**.

The cop boxing device 62 can, at the home position **62*h* thereof, discharge the cop magazine (hereinafter referred to only as magazine), in which the cops are accommodated, onto a turntable 63*a* which forms a starting end portion of the cop transport conveyor system 10. Meanwhile, another turntable 63*b* is provided at a last end of an empty magazine conveyor system 40 which is disposed in such a manner as to reach the home position 62*h*, and the cop boxing device 62 can carry thereon an empty cop magazine (hereinafter referred to only as empty magazine) which has come to the turntable 63*b***, thereby to make preparations for an accommodating operation for cops from another spinning frame Si.

The working device line 12 branches from the forward conveyor 11 at a branching point **12*a* and, passing a plurality of standby lines 12*b* and a working device 12*c* which performs a setting process of a cop, for example, by steam, joins the forward conveyor 11 at a joining point 12*d*. The working device 12*c* can make batch processing of a plurality of occupied magazines while each of the standby lines 12*b* can store in a row thereon at least a number of occupied magazines corresponding to one batch of the working device 12*c*. A branch point 12*e* and a joining point 12*f* are formed on the upstream side and the downstream side, respectively, of each of the standby lines 12*b***.

On the other hand, the stock line 13 includes a plurality of rows of conveyors **13*a* each having a branch point 13*b* and a joining point 13*c* on the upstream side and the downstream side thereof, respectively. Each of the stock conveyors 13*a*** can store thereon, for example, a number of occupied magazines sufficient to absorb a difference in working capacity between the spinning frames Si which operate continuously day and night and the winders Wj which operate only in the daytime.

The branch conveyors 15 branch from the communicating conveyor 14 individually by way of branch points **15*a*. A cop feed device 15*b* is disposed intermediately of each of the branch conveyors 15 and operates to discharge cops from an occupied magazine transported thereto and forward only a cop into a winder Wj in response to a cop requesting signal from the winder Wj. In particular, on each of the branch conveyors 15, an occupied magazine is transported to the cop feed device 15*b*, but only cops are transported from the cop feed device 15*b*** to the winder Wj. Yarn end pickup devices Wja (j=1, 2, . . . , n) for picking up an end of a yarn of a cop are disposed at entrance ends of the winders Wj.

Empty magazines discharged from the cop feed devices **15*b* are fed back to the home position 62*h* by way of the empty magazine conveyor system 40 which includes a connecting conveyor 41, an empty magazine stock line 42 and a return conveyor 43. The empty magazines are thus used again by means of the cop boxing device 62**.

A tab setter 20 is disposed in or adjacent the home position **62*h* of the cop boxing device 62 which makes the starting point of the cop transport conveyor system 10. The tab setter 20** is provided to set and store a code (hereinafter referred to as tab code) indicative of a type of code accommodated in a cop magazine into a tab device provided on the cop magazine. Such tab code setting and storing means may be any one of, for example, mechanical, electronic, magnetic or some other means.

A tab reader 30 is disposed on the upstream side of each of the branch points 12*a*, 12*e*, 13*b* and 15*a* intermediately of the cop transport conveyor system 10.

Each of the tab readers 30 is provided to read a tab code set and stored for each cop magazine by the tab setter 20, discriminate a type of yarns accommodated in the cop magazine and selectively transport occupied magazine to a predetermined destination. For example, the tab reader 30 on the upstream side of the branch point 12*a* can discriminate whether an occupied magazine transported thereto on the forward conveyor 11 must necessarily advance into or should bypass the working process line 12. Meanwhile, the tab reader 30 on the upstream side of the branch points 13*b* can select one of the stock conveyors 13*a* in the stock line 13 for each type of yarns of cops in an occupied magazine, and consequently, the stock conveyors 13*a* can individually store thereon occupied magazines selected for individual types of yarns. Further, the tab reader 30 on the upstream side of the branch lines 15*a* can select a specific winder Wj in accordance with an individual type of a yarn.

A tab clearer 50 is disposed intermediately of the return conveyor 43 which forms part of the empty magazine conveyor system 40. The tab clearer is provided to clear the tab code set in the tab device of an empty magazine to assure the reliability of a resetting operation of a tab code by the tab setter 20.

A cop supplied to a winder Wj from a corresponding cop feed device 15*b* is at first subjected to a yarn end picking up operation by the yarn end pickup device Wja of the winder Wj and is then set for working on the winder Wj on which it is rewound, for example, into a cheese-like configuration, whereafter it is discharged to a next step by means of a conveyor system not shown. On the other hand, an empty bobbin (hereinafter referred to only as bobbin) from which a yarn has been unwound is checked that it has no remaining yarn thereon by means of a remaining yarn detecting device Wjb (j=1, 2, . . . , n) disposed at an exit end of the winder Wj, and then the bobbin is discharged onto a communicating conveyor 71 which makes part of the bobbin transport conveyor system 70.

The bobbin transport conveyor system 70 includes communicating conveyors 71, connecting conveyors 72 and a returning conveyor 73.

The communicating conveyors 71 individually communicate the winders Wj with the bobbin reservoirs Rj. A transverse conveyor 74 extends transversely to the communicating conveyors 71 so that any one of the winders Wj can communicate with an arbitrary one of the bobbin reservoirs Rj by way of the communicating conveyors 71 and the transverse conveyor 74.

The bobbin reservoirs Rj are provided to temporarily store therein bobbins discharged from the winders Rj and have bobbin loaders Rja (j=1, 2, . . . , n) provided therefor for transferring accumulated bobbins individually to the connecting conveyors 72.

Figure 2:
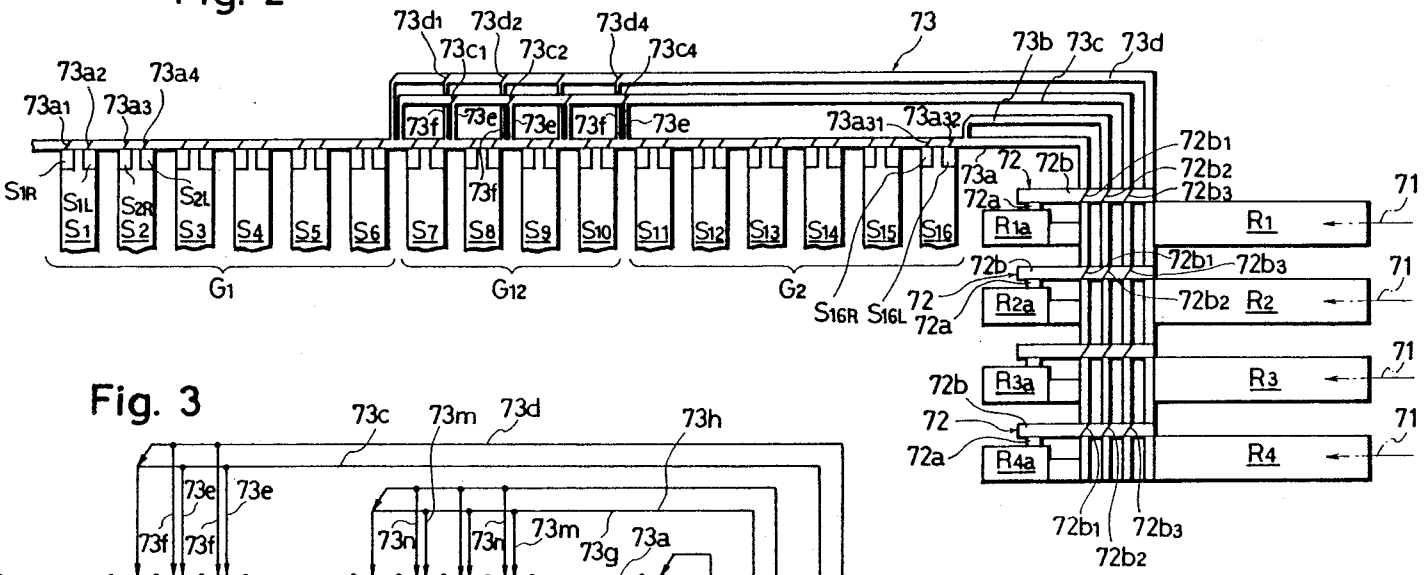
FIG. 2 is a diagrammatic representation showing details of part of the system shown in FIG. 1.

The connecting conveyors 72 are provided to transfer bobbin loaders Rja to the returning conveyor 73. Each of the connecting conveyors 72 includes, as shown in FIG. 2, a bucket conveyor 72*a* for successively scooping up and feeding out bobbins from the corresponding bobbin loader Rja, and a transfer conveyor 72*b* for transferring a bobbin from the bucket conveyor 72*a* to the returning conveyor 73. Each of the connecting conveyors 72 has change-over mechanisms 72*b*1, 72*b*2, . . . incorporated therein for selectively transporting bobbins to a main transport path 73*a*, a spare main transport path 73*b*, a sub transport path 73*c* and a spare sub transport path 73*d* which generally constitute the returning conveyor 73.

The returning conveyor 73 supplies bobbins from within the bobbin reservoirs Rj to the spinning frames Si by way of the bobbin loaders Rja and the connecting conveyors 72.

The returning conveyor 73 may be constituted, for example, such that it includes an endless drive belt for receiving and moving empty bobbins in a laid down condition and a pair of side walls provided uprightly on the opposite side of the endless belt, and empty bobbins are laid successively in a row on the endless drive belt to transport the empty bobbins.

It is to be assumed here that there are up to 16 spinning frames Si (i=1, 2, . . . , m, m=16), and the six spinning frames S1, S2, . . . , S6 on the downstream side in the bobbin supplying direction form a first dedicated machine group G1; the four spinning frames S7, S8, S9, S10 on the upstream side of the first dedicated machine group G1 form a common machine group G12; and the six spinning frames S11, S12, . . . , S16 on the most upstream side form a second dedicated machine group G2. It is to be noted that each of the spinning frames Si has a pair of spindles not shown on the right- and left-hand sides thereof and further has a pair of bobbin receiving devices SiR and SiL (i=1, 2, . . . , m) for the right- and left-hand sides provided for the spindles. Further, FIG. 2 shows as up to four bobbin reservoirs Rj and four bobbin loaders Rja are used (n=4).

The main transport path 73*a*, spare main transport path 73*b*, sub transport path 73*c* and spare sub transport path 73*d* individually serve as conveyor lines for supplying bobbins from the transfer conveyors 72*b* to the spinning frames Si. The main transport path 73*a* is disposed very closely to the out end sides of the spinning frames Si and extend over the full extent from the spinning frame S16 to the spinning frame S1 so that it may supply bobbins to all of the spinning frames Si. Further, the main transport path 73*a* has change-over mechanisms 73*a*1, 73*a*2, . . . , 73*a*32 provided therefor corresponding to the bobbin receiving devices SiR and SiL of the individual spinning frames Si. The spare main transport path 73*b* joins the main transport path 73*a* on the upstream side very near to the spinning frame S16 on the most upstream side.

The sub transport path 73*c* and the spare sub transport path 73*d* are arranged in a juxtaposed relationship to each other and both join the main transport path 73*a* on the upstream side very near to the most upstream side one S6 of the spinning frames S1 to S6 which belong to the first dedicated machine group G1. Meanwhile, a communicating transport path 73*e* for communicating the sub transport path 73*c* with the main transport path 73*a* and a spare communicating transport path 73*f* for communicating the spare sub transport path 73*d* with the main transport path 73*a* are disposed on the upstream side very near to each of the spinning frames S7 to S10 which belong to the common machine group G12, and change-over mechanisms 73*c*1, 73*c*2, . . . and 73*d*1, 73*d*2, . . . corresponding to the communicating transport paths 73*e* and spare communicating transport paths 73*f* are incorporated in the sub transport path 73*c* and the spare sub transport path 73*d*, respectively. Each of such change-over mechanisms may include, for example, an opening and closing plate which is quickly opened or closed by an air cylinder or an electric actuator in response to an opening/closing control signal.

It is to be noted that each of the change-over mechanisms is provided to make a changing over operation so that a bobbin transported by the main transport path may be sent into a predetermined spinning frame, and where the spinning frames are of the opposite side type having spindles on the opposite right- and left-hand sides thereof, such change-over mechanisms are provided correspondingly on the opposite sides of the spinning frames so that bobbins may be supplied to the opposite sides of the spinning frames.

The bobbin supply system for spinning frames having such a construction as described above operate in the following manner.

It is assumed here that the spinning frames S1 to S6 which belong to the first dedicated machine group G1 form a first group while the spinning frames S7 to S16 which belong to the common machine group G12 and the second dedicated machine group G2 form a second group, and the spinning frames are working with different types of yarns set thereon. In this instance, two different types of bobbins for different types of yarns are discharged from the winders Wj and individually thrown into the different bobbin reservoirs R1 and R2 by way of the corresponding communicating conveyors 71 and the transverse conveyor 74. Thereupon, the other bobbin reservoirs R3 and R4 may receive yarns of the same types with the bobbin reservoirs R1 and R2 or otherwise may be left at rest. It is assumed here, however, that bobbins to be used on the spinning frames Si ($i=1, 2, \ldots, 6$) which belong to the first group are thrown into the bobbin reservoir R1 while bobbins to be used on the spinning frames Si ($i=7, 8, \ldots, 16$) which belong to the second group are thrown into the bobbin reservoir R2.

The bobbin loader R1*a* operates in response to a bobbin requesting signal from any one of the spinning frames Si which belong to the first group and can thus supply a bobbin from within the bobbin reservoir R1 to the spinning frame Si by way of the corresponding bucket conveyor 72*a*, transfer conveyor 72*b*, and sub transport path 73*c* or main transport path 73*a*. In particular, a bobbin which has been transferred from a bucket conveyor 72*a* to a corresponding transfer conveyor 72*b* is then transferred to the sub transfer path 73*c* by a corresponding change-over mechanism 72 at the location at which the transfer conveyor 72*b* crosses the sub transport path 73*c*, whereafter the bobbin is transferred to the main transport path 73*a* at the last end of the sub transport path 73*c*. Consequently, the bobbin can be sent into the bobbin receiving device SiR or SiL of the predetermined spinning frame Si by suitably operating one of the change-over mechanisms 72*ak*-1 and 72*ak* ($k=2i$) corresponding to the predetermined spinning frame Si.

Similarly, a bobbin within the bobbin reservoir R2 can be supplied to an arbitrary one of the spinning frames Si belonging to the second group by way of the corresponding bobbin loader R2*a*, bucket conveyor 72*a*, transfer conveyor 72*b* and main transport path 73*a*. In this instance, a corresponding change-over mechanism 72*b*1 transfers the bobbin from the transfer conveyor 72*b* to the main transport path 73*a*.

In this instance, since there is no overlapping portion between bobbin supply routes to spinning frames Si and Sj ($1 \leqq i \leqq 6$, $7 \leqq j \leqq 16$) which belong to different groups from each other, they can receive supply of bobbins in a simultaneous relationship with each other.

When the type of yarns to be set on the spinning frames Si which belong to the first group is to be changed, new bobbins for use with a new type of yarns are prepared in the bobbin reservoir R3 in advance, and then, upon changing over of the yarn type, bobbins of the new type can be supplied to the spinning frames Si of the first group by way of the bobbin loader R3*a*, transfer conveyor 72*b*, spare sub transport path 73*d* and main transport path 73*a*. Supply of bobbins of a new type to the spinning frames Si belonging to the second group takes place in a similar manner, and new bobbins prepared in the bobbin reservoir R4 may be supplied by way of the spare main transport path 73*b*.

Subsequently, such a case will be examined that some of the spinning frames S7, S8, . . . , S10 which belong to the common machine group G12 are to be changed from the second group to the first group. In this instance, bobbins for use with the first group should be supplied in place of bobbins for use with the second group in response to a bobbin requesting signal from a spinning frame Sk which should be changed from the second group to the first group. In particular, if it is assumed that the two spinning frames S7 and S8 are to be changed from the second group to the first group, then a bobbin for use with the first group which is accommodated in either one of the bobbin reservoirs R1 and R3 is transported to the main transport path 73*a* by way of the sub transport path 73*c* or spare sub transport path 73*d* and the communicating transport path 73*d* or spare communicating transport path 73*f* corresponding to the spinning frame S8. Consequently, the position at which the sub transport path 73*c* or spare sub transport path 73*d* joins the main transport path 73*a* can be substantially changed to a position on the upstream side very near to the spinning frame S8. Accordingly, the spinning frames S7 and S8 can be thereafter treated as they belong to the first group. In this instance, however, since the communicating transport path 73*e* and spare communicating transport path 73*f* corresponding to the spinning frame 8 are used, flows of bobbins on the sub transport path 73*c* and spare sub transport path 73*d* should be changed over by the change-over mechanisms 73*c*2 and 73*d*2 corresponding to such transport paths 73*e* and 73*f*.

Since this can be realized in a quite similar manner with all of the spinning frames Si ($i=7, 8, \ldots, 10$) which belong to the common machine group G12, the spinning frames S7 to S10 can be divided into two groups individually including arbitrary numbers of spinning frames in accordance with required production lot amounts for individual types of yarns so that they may individually belong to either one of the first and second groups. Accordingly, the boundary between the first and second groups can be selected arbitrarily.

While the sub transport path may be constructed so that it may supply at least two types of bobbin as described above, where a spare sub transport path is provided in a juxtaposed relationship and extends to a position at which the sub transport path joins the main transport path and also the communicating transport paths are provided with spare communicating transport paths accordingly, new bobbins which are to be supplied after changing over can be transported onto the spare sub transport path in advance. Consequently, when the type of bobbins is to be changed over, the time required for supply of bobbins can be reduced.

Other Embodiments

It is a matter of course that the system shown in FIG. 2 may include an arbitrary total number of spinning frames Si and each of the first and second dedicated machine groups G1 and G2 and the common machine group G12 may include an arbitrary number of spinning frames Si. However, the sub transport path 73*c* and the spare sub transport path 73*d* should join the main transport path 73*a* on the upstream side very close to a most upstream side one of the spinning frames Si which belong to the first dedicated machine group G1 while the communicating transport paths 73*e* and the spare communicating paths 73*f* should be provided for all of the spinning frames Si which belong to the common machine group G12.

Figure 3:
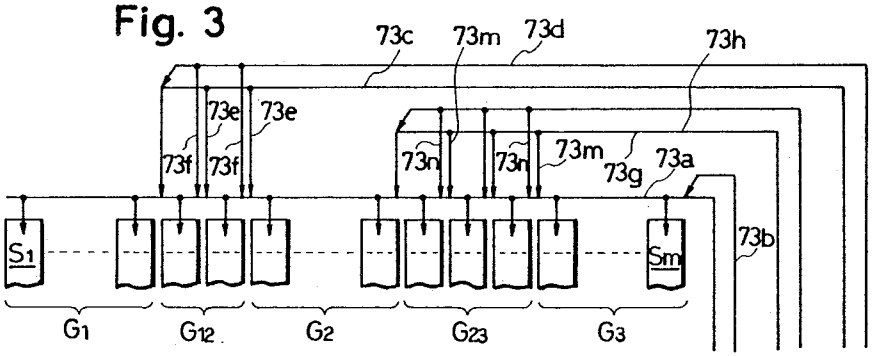
FIG. 3 is a diagrammatic representation schematically showing another embodiment of the present invention.

The spinning frames Si may be divided into three dedicated machine groups G1, G2 and G3 and two common machine groups G12 and G13 as shown in FIG. 3. In this instance, two sub transport paths 73*c* and 73*g* and two spare rib transport paths 73*d* and 73*h* should be provided for supplying bobbins to the dedicated machine groups G1 and G2 except the dedicated machine group G3 on the most upstream side while communicating transport paths 73*e* and 73*m* and spare communicating transport paths 73*f* and 73*n* should be provided for the individual spinning frames Si which belong to the common machine groups G12 and G23, respectively.

Further, the present embodiment can be accommodated for expansion to an arbitrary number of dedicated machine groups G1, G2, . . . and common machine groups G12, G23, . . .

Figure 4:
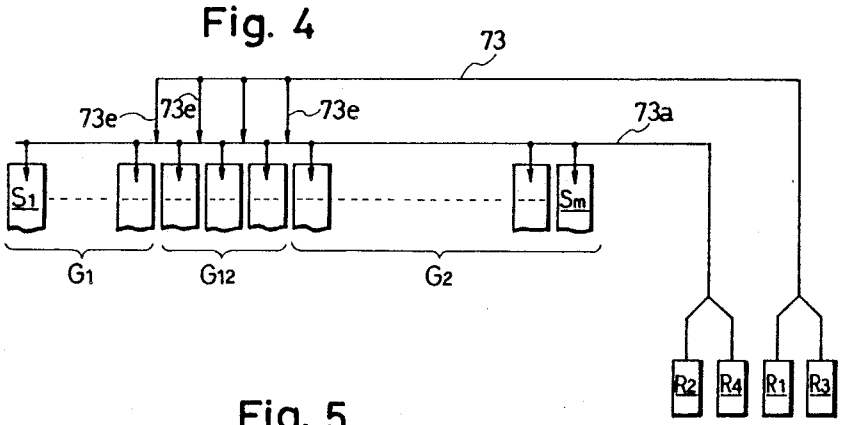
FIG. 4 is a similar view but showing a further embodiment of the present invention.
Figure 5:
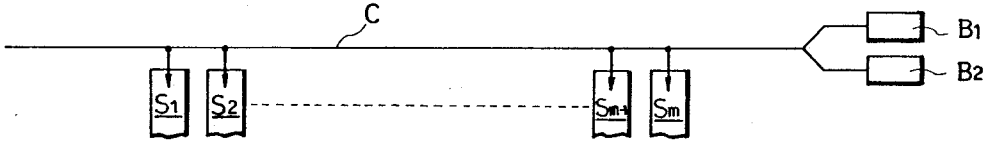
FIGS. 5 and 6 are similar views but showing exemplary ones of conventional yarn supply systems.
Figure 6:
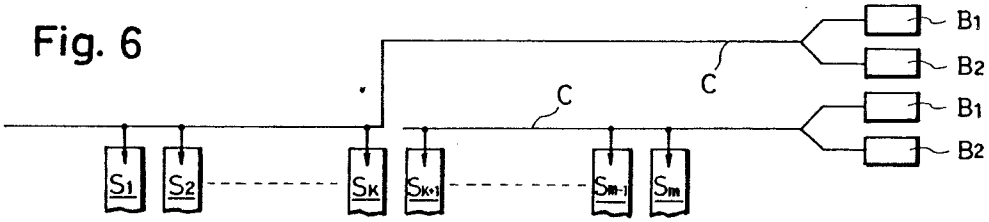

Further, in each of the embodiments described above, the spare main transport path 73*b* and the spare sub transport path 73*d* can be omitted as shown in FIG. 4. In particular, referring to FIG. 4, the main transport path 73*a* and the sub transport path 73*c* may be connected in a branching manner at the starting ends thereof to the bobbin reservoirs R2 and R4 and the bobbin reservoirs R1 and R3, respectively, in preparation for changing of a type of a yarn for a spinning frame Si. It is to be noted that each of the main transport path 73*a* and the sub transport path 73*c* must only be constructed generally such that at least it can alternatively supply two different types of bobbins including bobbins in use at present and bobbins to be used anew, and upon changing to a new type of yarns, old bobbins in a bobbin reservoir Rj should be replaced by new bobbins. However, where the main transport path 73*a* and the sub transport path 73*c* are constructed such that each of them can supply three or more types of bobbins, then the opportunities for such replacing operation of bobbins are reduced, allowing more convenient use of the bobbin supply system.

What is claimed is:

1. A bobbin supply system for spinning frames for supplying a plurality of types of bobbins in a set manner to a plurality of spinning frames, wherein said spinning frames are divided into a plurality of dedicated machine groups each for working yarns of a fixed type and a common machine group disposed between each adjacent ones of said dedicated machine groups for working yarns of a selected one or ones of different types, wherein said system comprises a main transport path capable of supplying bobbins to all of said dedicated machine groups and the common machine group or groups from an upstream side of said main transport path toward a downstream side of said main transport path, a sub transport path joined to said main transport path at a boundary position between each of the common machine group or groups and an adjacent one of said dedicated machine groups on a downstream side of the common machine group for supplying bobbins to the spinning frames on a downstream side of the boundary position, and a communicating transport path provided for each of the spinning frames of the common machine group or machine groups adjacent the boundary position or positions for establishing communication between said sub transport path and said main transport path.

2. A bobbin supply system for spinning frames according to claim 1, wherein said spinning frames are divided into more than two dedicated machine groups and more than one machine group, and said main transport path and said sub transport path are constructed such that they are capable of supplying more than two different types of bobbins.

3. A bobbin supply system for spinning frames according to claim 1 or 2, wherein said main transport path includes a change-over mechanism provided for each of said spinning frames for changing over between supply and stopping of supply of bobbins to the spinning frame.

4. A bobbin supply system for spinning frames according to claim 3, wherein each of said spinning frames include a pair of opposing spindles on right- and left-hand sides of each of said spinning frames, and the change-over mechanism is disposed on each of the right- and left-hand sides of each of said spinning frames.

5. A bobbin supply system for spinning frames according to claim 1, wherein a spare sub transport path is provided in a juxtaposed parallel relationship to said sub transport path, and spare communicating transport paths for establishing communication between said spare sub transport path and said main transport path are disposed in parallel to the communicating transport paths.

6. A bobbin supply system for spinning frames according to claim 5, wherein branching positions are provided between said spare sub transport path and each of said spare communicating transport paths, and a change-over mechanism is provided at each of said branching positions.

7. A bobbin supply system for spinning frames according to claim 1, comprising:

bobbin reservoirs for temporarily storing different types of bobbins; and connecting conveyors for connecting said main transport path and said sub transport path to said bobbin reservoirs.

8. A bobbin supply system for spinning frames according to claim 1, wherein branching positions are provided between said sub transport path and each of said communicating transport paths, and a change-over mechanism is provided at each of said branching positions.

* * * * *